United States Patent [19]

Seaborn

[11] 3,956,836

[45] May 18, 1976

[54] ALBUM

[75] Inventor: Paul E. Seaborn, Los Gatos, Calif.

[73] Assignee: The Mead Corporation, Dayton, Ohio

[22] Filed: Dec. 17, 1974

[21] Appl. No.: 533,477

[52] U.S. Cl. ..... 40/102

[51] Int. Cl.[2] ..... G09F 11/06

[58] Field of Search ..... 40/102, 104.19; 281/21 R, 23, 15, 16, 17

[56] References Cited

UNITED STATES PATENTS

| | | | |
|---|---|---|---|
| 1,170,793 | 2/1916 | Ballantine | 281/15 R |
| 2,127,619 | 8/1938 | Rosenthal | 281/17 |
| 2,802,677 | 8/1957 | Forsyth | 281/16 |
| 3,669,555 | 6/1972 | Holes et al. | 40/104.18 |
| 3,793,758 | 2/1974 | Feldhusen et al. | 40/102 |

*Primary Examiner*—Louis G. Mancene
*Assistant Examiner*—John H. Wolff
*Attorney, Agent, or Firm*—Biebel, French & Nauman

[57] ABSTRACT

An album or similar book-like article having a flexible one-piece spine of extruded construction which includes a series of fingers extending the length of the spine and projecting from an inner surface thereof. A three ply, laminated page formed with the center ply shorter than the outer plies to provide a slot extending along one edge of the page is attached to each finger by gluing the fingers in the slots. The spine is provided with areas of reduced thickness extending longitudinally thereof intermediate each pair of fingers to provide increased flexiblity at these points and thereby allow the pages to lie flat when the album is open. Additionally, fasteners are provided for interconnecting two or more album units to form a composite album.

10 Claims, 4 Drawing Figures

ALBUM

BACKGROUND OF THE INVENTION

Albums, such as photo albums, are generally constructed somewhat differently from other book-like articles in that the pages are preferably somewhat heavier than other book pages, and it is desirable that the pages lie flat when the album is open. The simplest manner of fulfilling the latter requirement is by means of a so called loose leaf binder, wherein the edges of the pages are punched to receive the binder rings. However, because the pages of an album are of somewhat heavier construction and have other material, such as photographs, coins, etc., mounted thereon, the resulting weight will often cause tearing of the pages from the binder rings.

A number of constructions have been proposed for book-like articles in which the leaves or pages can be laid out flat when the book is open. See for example, U.S. Pats. Nos. 1,478,522; 1,170,793; and 3,793,758. However a need is still seen to exist for an album type book in which the pages are attached firmly to the spine and not easily torn loose and yet an album in which the pages lie flat when the album is open.

SUMMARY OF THE INVENTION

An album in accordance with the present invention includes a spine of extruded construction formed preferably of a flexible synthetic resinous material, which has a series of regularly spaced fingers projecting from one surface of the spine and extending the length thereof.

The pages are of sturdy three-ply construction with the center ply somewhat shorter in width than the outer plies to provide a continuous slot extending the length of the edge of the page.

The pages are attached to the spine by inserting the fingers of the spine into the slots and gluing them in place. This provides a heavy duty construction in which the pages and spine function similarly to an integral construction and thus resist tearing of the pages from the album.

The spine is formed with areas of reduced thickness extending longitudinally thereof between adjacent fingers to increase the flexibility of the spine at these points. As a result, the pages will lie flat when the album is opened despite the heavy duty construction thereof.

In accordance with a further feature of the invention, means are provided for interconnecting several album units to form a composite album. In one embodiment, the album units may be interconnected by means of snap-type fasteners, while in a second embodiment album units are provided with a T-shaped slot along one edge and a complementary shaped rail extending along the opposite edge.

DESCRIPTION OF THE PREFERRED EMBODIMENTS

Figure 1:
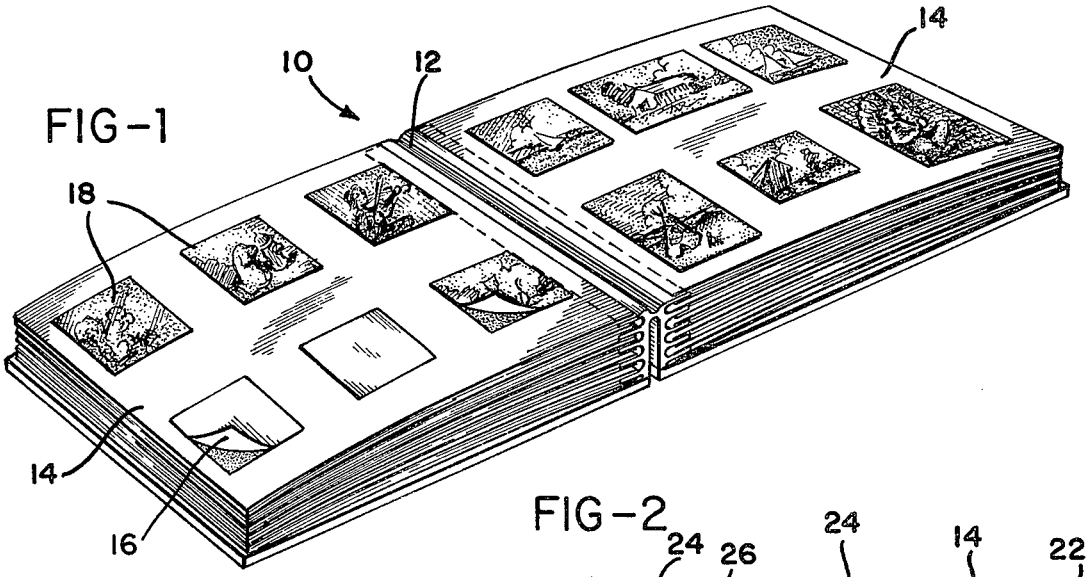
FIG. 1 is a perspective view of an album in accordance with the present invention showing the album open and the pages lying flat.

As seen in FIG. 1 of the drawings, an album 10 in accordance with the present invention includes a spine 12 to which are attached a plurality of pages 14. The album shown for purposes of illustration is depicted as a photo album, although it will be apparent that the present invention may be used for albums generally. As shown in FIG. 1, areas of pressure sensitive adhesive may be provided on each page with a masking cover 16 which may be peeled off and a photograph 18 adhered to the adhesive coated area.

Figure 2:
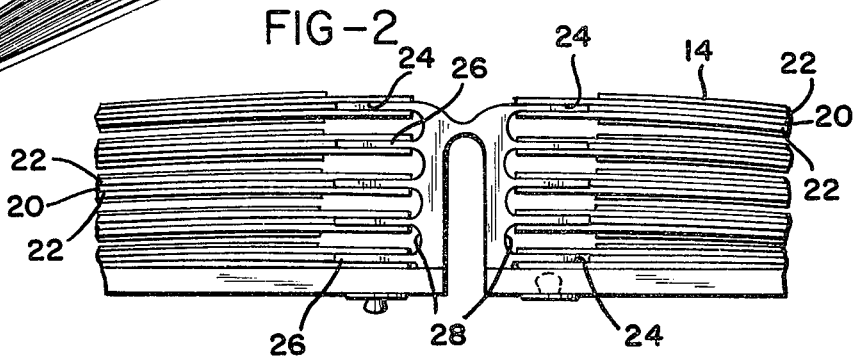
FIG. 2 is a cross-sectional view through the album.

As best seen in FIG. 2 of the drawings, each page 14 is of laminated construction with one ply 20 of shorter width than adjacent plies 22 to define a groove 24 receiving a finger 26 of the spine. Preferably the fingers 26 are secured in the grooves 24 by gluing, although it will be apparent that other methods of attachment may also be used. With the pages and spine interconnected in this manner, they function as an integral unit, providing maximum resistance to tearing of the pages from the album.

Figure 3:
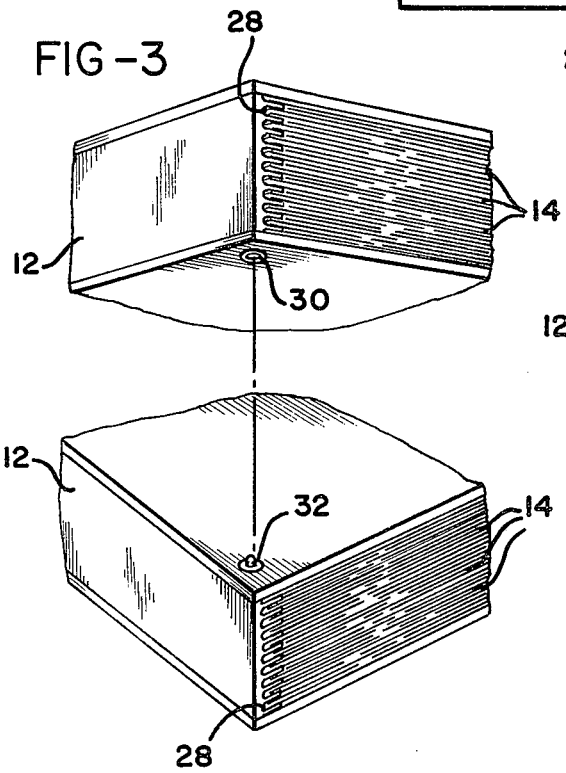
FIG. 3 is a perspective view showing one manner in which several album units can be interconnected.

It will also be noted that the spine is provided with areas of reduced thickness 28 which extend the length of the spine intermediate adjacent fingers to increase the flexibility of the spine at these areas. Thus, despite the face that the pages and spine function as an integral unit, the pages will lie flat when the album is opened, as indicated in FIG. 1 of the drawings.

Where it is desired to expand the album, a series of album units can be interconnected, as shown in FIG. 3 of the drawings, by providing complementary snaps 30,32 along opposite edges of each of the spines. As a result two or more album units can be interconnected by simply snapping the snaps 30 along one edge of one spine into engagement with the complementary snaps 32 along the opposite edge of a second spine.

Figure 4:
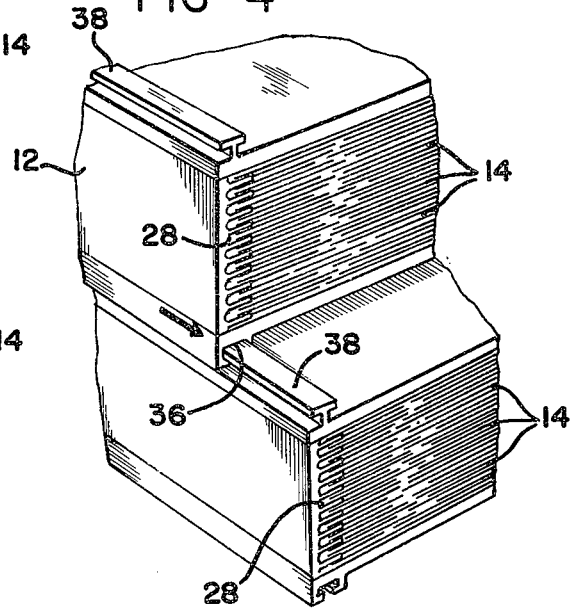
FIG. 4 is a view similar to FIG. 3, but showing a second embodiment of fastening means.

Another method of interconnecting a plurality of album units is depicted in FIG. 4 of the drawings wherein it will be seen that a T-shaped groove 36 is formed along one edge of each unit complementary to a T-shaped rail 38 formed along the opposite edge of the spine. As indicated in FIG. 4 of the drawings, two or more album units can then be interconnected by simply sliding the rail of one spine into the groove of another.

From the above it will be seen that the present invention provides an album or similar book-like article in which the pages are attached securely to the spine of the album so that the pages and spine function as an integral unit, but yet the pages of the album will lie flat when the album is opened. Additionally, where desired a plurality of album units can be interconnected to form a composite album.

While the articles herein described constitute preferred embodiments of the invention, it is to be understood that the invention is not limited to these precise articles, and that changes may be made therein without departing from the scope of the invention.

What is claimed is:

1. An album comprising:

a. a flexible, spine of unitary construction having inner and outer surfaces, b. a plurality of fingers projecting substantially normally from said spine inner surface in spaced, substantially parallel relationship to each other, c. said spine being of reduced thickness at areas thereof intermediate said fingers, d. a plurality of pages, e. each of said pages having an opening in an edge surface thereof receiving one of said fingers, and f. means for securing said fingers in said openings.

2. The album of claim 1 wherein:

a. each of said fingers extends the length of said spine.

3. The album of claim 2 wherein:

a. said openings in said pages comprise slots extending the length of said pages.

4. The album of claim 3 wherein:

a. said pages are of laminated construction with an intermediate ply of less width than the outer plies to define said slot.

5. The album of claim 1 wherein:

a. said spine is of extruded construction.

6. The album of claim 5 wherein:

a. said spine is formed of a synthetic resinous material.

7. The construction of claim 1 further comprising:

a. means for joining said spine to other, similar spines with said spines extending in superimposed parallel relationship to each other.

8. The album of claim 7 wherein:

a. said joining means comprises complementary snap type fasteners on said spines.

9. The album of claim 7 wherein said joining means comprises:

a. a groove formed along one edge of each of said spines, and b. a complementary configured rail formed along an opposite edge of each of said spines.

10. The album of claim 1 wherein:

a. said spine is formed of a synthetic resinous material.

* * * * *